US006596915B1

(12) United States Patent
Satyapal et al.

(10) Patent No.: US 6,596,915 B1
(45) Date of Patent: Jul. 22, 2003

(54) CATALYSTS FOR DESTRUCTION OF ORGANOPHOSPHONATE COMPOUNDS

(75) Inventors: Sunita Satyapal, East Hampton, CT (US); James D. Freihaut, South Windsor, CT (US)

(73) Assignee: Carrier Corporation, Farmington, CT (US)

( * ) Notice: Subject to any disclaimer, the term of this patent is extended or adjusted under 35 U.S.C. 154(b) by 61 days.

(21) Appl. No.: 09/665,805

(22) Filed: Sep. 20, 2000

Related U.S. Application Data

(60) Provisional application No. 60/155,430, filed on Sep. 22, 1999.

(51) Int. Cl.[7] ..... A62D 3/00

(52) U.S. Cl. ..... 588/216; 588/221; 588/205; 588/218; 588/244; 502/353; 502/324; 423/245.1

(58) Field of Search ..... 588/200, 205, 588/206, 207, 209, 213, 214, 220, 228, 244, 245, 221, 216, 218; 423/210, 240 S, 240 R, 245.1, 245.3; 502/300, 324, 353, 354

(56) References Cited

U.S. PATENT DOCUMENTS

| | | | | | |
|---|---|---|---|---|---|
| 5,759,939 | A | * | 6/1998 | Klabunde et al. | 502/238 |
| 5,914,436 | A | * | 6/1999 | Klabunde et al. | 588/205 |
| 6,057,488 | A | * | 5/2000 | Koper et al. | 588/200 |
| 6,121,191 | A | * | 9/2000 | Komatsu et al. | 502/330 |

FOREIGN PATENT DOCUMENTS

| | | | | | |
|---|---|---|---|---|---|
| DE | 19757496 | A1 | | 6/1999 | B01J/27/128 |
| DE | 19757496 | A1 | * | 6/1999 | B01J/27/128 |
| EP | 0818239 | A1 | | 1/1998 | B01J/35/02 |
| JP | 4-83515 | A | * | 3/1992 | B01D/53/36 |
| JP | 07030303 | | | 3/1995 | B01J/23/24 |
| WO | 9712672 | | | 4/1997 | B01J/23/00 |

OTHER PUBLICATIONS

Grant, Hackh's Chemical Dictionary, Fourth Edition, McGraw–Hill Inc., p. 516, 1969.*

* cited by examiner

*Primary Examiner*—Steven Bos
*Assistant Examiner*—Anthony Kuhar
(74) *Attorney, Agent, or Firm*—William W. Habelt

(57) ABSTRACT

Volatile organic compounds, for example organophosphonate compounds including chemical warfare agents, pesticides, and solvents, are decomposed by contacting the compounds with either a manganese oxide catalyst in the presence of visible light or a catalyst material selected from the group consisting of vanadium, vanadium oxide, manganese oxide and mixtures thereof deposited upon a catalyst support that is heated to at least 300° C. The catalyst material may be regenerated by a process selected from the washing with water, washing with a solvent, heating, exposing to light, purging with oxygen, purging with a reactive gas, exposing to microwave radiation, and combinations thereof. The catalyst composition may be used as an air filter in a vehicle, a building or a personnel protection device, such as a gas mask.

3 Claims, 4 Drawing Sheets

CATALYSTS FOR DESTRUCTION OF ORGANOPHOSPHONATE COMPOUNDS

This application is a continuation application of provisional application Ser. No. 60/155,430, filed Sep. 22, 1999.

BACKGROUND OF THE INVENTION

The present invention relates generally to compositions effective for destroying hazardous compounds and, more particularly, to compositions effective to catalyzing the oxidation of organophosphorus compounds, including chemical warfare agents, pesticides and solvents.

Numerous catalysts have been studied over the years for the decomposition of hazardous compounds. However, one of the difficulties in the practical application of a catalyst is the fact that the catalyst may degrade or become poisoned over time. In several cases, a reaction product causes poisoning of the catalyst due to strong adsorption on the catalyst surface, and further reaction is impeded. Specifically, organophosphonate-type compounds, such as chemical warfare agents and pesticides, are known to cause catalyst poisoning because phosphorus species tend to bind strongly to catalytically active sites.

Various patents disclose methods for the destruction of hazardous wastes, toxic compounds and chemical warfare agents. U.S. Pat. No. 5,451,738 discloses the plasma arc decomposition of hazardous wastes into vitrified solids and non-hazardous gasses. U.S. Pat. No. 5,545,799 describes the chemical destruction of toxic organic compounds by means of an oxidizing reaction between, for example a chlorine-containing or arsenic-containing compound, and an oxidizing agent, for example hydrogen peroxide at a temperature of 50–90° C., and at specific pHs. U.S. Pat. No. 5,760,089 discloses a chemical warfare agent decontaminant solution using quaternary ammonium complexes. WO Patent 9718858 describes a method and apparatus for destroying chemical warfare agents based on reaction with a nitrogenous base containing solvated electrons.

U.S. Pat. No. 4,871,526 describes the heterogeneous catalytic oxidation of organophosphonate esters using a molybdenum catalyst. As disclosed therein, the reaction results in the production of carbon monoxide and phosphorus oxide(s) without the undesired accumulation of carbonaceous or phosphorus overlayers on the molybdenum surface. In fact, molybdenum is one of the only species shown to be resistant to poisoning by phosphorus compounds.

European Patent 0501364 discloses a low chromium activated charcoal for destroying chemical warfare agents. As disclosed therein, the amount of active metal, such as chromium VI, in the activated charcoal or ASC whetlerite charcoal catalyst is reduced by as much as 50% via a freeze-drying technique without reducing the activity of the charcoal. These materials are used in providing protection against chemical warfare agents but because chromium VI is a known carcinogen, disposal of the spent charcoal is a problem.

Several studies have been reported on the catalytic decomposition of DMMP on various catalysts, including Ni (1 1 1), Pd (1 1 1), Rh (1 0 0), $Al_2O_3$, Mo (1 0 0), $Fe_2O_3$, $SiO_2$ and Pt. In most of the studies, with the exception of Mo (1 0 0), the catalytic reaction was not sustained due to accumulation of products on the catalyst surface. In the case of Mo (1 0 0) in the presence of $O_2$, phosphorous oxide and carbon monoxide were observed as products at high temperatures (roughly 520° C.). Rather than phosphorus-containing compounds on the surface, only $O_2$ was measured on the catalyst surface. However, if $O_2$ was not used in the reaction, phosphorus-containing species were found to accumulate on the surface. The proposed catalyst may be doped with Mo in order to enhance sustained catalytic activity and to reduce degradation. In addition, the use of an oxygen or air purge may be employed.

Others have studied various supports for AMO such as zeolites, clays, $Al_2O_3$, $SiO_2$, $V_2O_5$, CaO, $TiO_2$, with C and MgO showing significantly greater activity than the others Manganese oxides are unique compared to most other oxides such as $SiO_2$ and $Al_2O_3$. For example, in the reaction of DMMP on silica, others have found that DMMP desorbs molecularly at high temperatures rather than decomposing. Alumina, as well, was found to be only marginally effective in the decomposition of DMMP. The use of iron oxide, however, proved to be more effective because the iron may be reduced.

SUMMARY OF THE INVENTION

It is an object of the present invention to provide compositions effective for catalyzing the destruction of organophosphorus compounds including chemical warfare agents, pesticides, and solvents. As used herein, destruction means the chemical decomposition or conversion to relatively non-toxic products.

In accordance with the present invention, there is provided a composition comprising a catalyst material selected from the group consisting of vanadium oxide or manganese oxide deposited upon a catalyst support selected from the group consisting of alumina or silica.

BRIEF DESCRIPTION OF THE DRAWINGS

The various features, advantages and objects which characterize the present invention will become more evident from the following detailed description of the invention with reference to the accompanying drawings, wherein.

DESCRIPTION OF THE INVENTION

Various metal-oxide and carbon based catalysts were synthesized using impregnation methods and their effectiveness for the destruction of dimethyl methyl phosphonate (DMMP), a simulant for nerve gas, evaluated at various operating conditions. To make the catalysts, a support material was impregnated with a soluble salt of the catalyst metal.

The support materials employed were $\gamma$-$Al_2O_3$, amorphous $SiO_2$ and P-25 $TiO_2$. The precursor salts for the preparation of catalysts were: $Ni(NO_3)_2.6H_2O$; $Fe(NO_3)_2.9H_2O$; $Cu(NO_3)_2.2.5H_2O$; $NH_4VO_3$; and $Pt(acac)_2$. With the exception of $Pt(acac)_2$, each salt was dissolved in distilled deionized water to form a solution. $Pt(acac)_2$ was dissolved in ethanol. Support material was then added to the solutions and stirred at room temperature for 12 hours. The solutions were then evaporated and dried at 393 K. Chunks of samples were recovered, ground and then calcined at 723 K for 6 hours. Powdered samples were pelleted and sieved into 28–48 mesh particles for catalytic tests.

EXAMPLE I

Approximately 5 grams of a catalyst (catalyst plus catalyst support) consisting of nickel supported on alumina ($Al_2O_3$), with the nickel constituting 10% of the total supported catalyst weight, was synthesized as follows. First, 2.478 grams of $Ni(NO_3)_2.6H_2O$ was dissolved in 100 ml deionized water. Then, 4.364 grams of $\gamma$-$Al_2O_3$ was added into the solution. After stirring at room temperature for 12 hours, the solution was slowly allowed to evaporate until the formation of a slurry occurred, which was subsequently dried at 120° C. for 12 hours. The sample was then calcined at 450° C. for 6 hours. The powder-like sample was ground, pelleted and sieved into 28–48 mesh particles for catalytic tests.

The procedure for preparation of other metal-oxide catalysts on supports was similar to the preparation described in Example I for $Ni/Al_2O_3$ sample. The catalysts synthesized, with the precursors, supports and solvents used, are set forth in Table 1.

TABLE 1

| Sample | Precursor | Support | Solvent |
|---|---|---|---|
| 10% $Ni/Al_2O_3$ | $Ni(NO_3)_2.6H_2O$ | $Al_2O_3$ | water |
| 10% $Fe/Al_2O_3$ | $Fe(NO_3)_2.9H_2O$ | $Al_2O_3$ | water |
| 10% $Cu/Al_2O_3$ | $Cu(NO_3)_2.2.5H_2O$ | $Al_2O_3$ | water |
| 10% $Pt/Al_2O_3$ | $Pt(acac)_2$ | $Al_2O_3$ | ethanol |
| 1% $V/Al_2O_3$ | $NH_4VO_3$ | $Al_2O_3$ | water |
| 5% $V/Al_2O_3$ | $NH_4VO_3$ | $Al_2O_3$ | water |
| 1% $V/Al_2O_3$ | $NH_4VO_3$ | $Al_2O_3$ | water |
| 10% $V/SiO_2$ | $NH_4VO_3$ | $SiO_2$ | water |
| 10% $V/TiO_2$ | $NH_4VO_3$ | $TiO_2$ | water |

Figure 1:
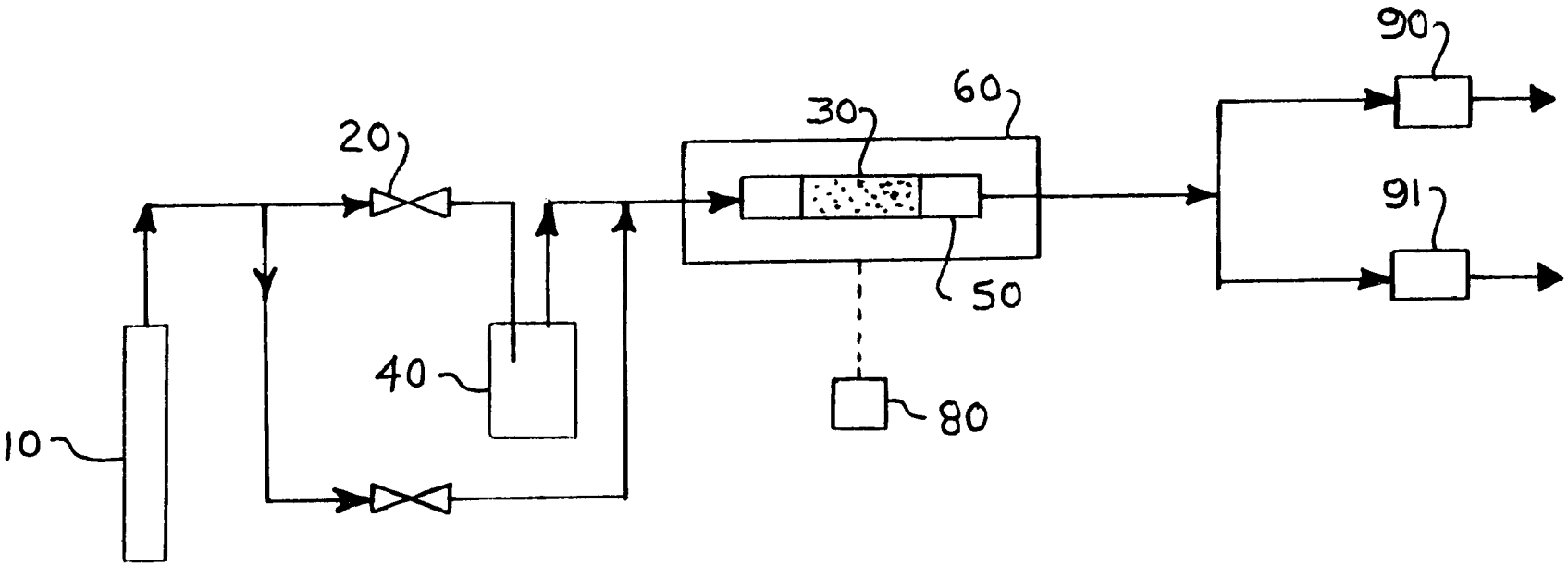
FIG. 1 is a schematic diagram illustrating the experimental system used to evaluate the activity of various compositions as catalysts for the destruction of organophosphorus compounds.

The experimental set up shown in FIG. 1 was used to evaluate the activity of the catalysts. For demonstration purposes dimethyl methyl phosphonate, $(CH_3)$—P(=O)$(OCH_3)_2$, (commonly referred to as DMMP) was used as the pollutant. The decomposition of this compound is useful for understanding the decomposition chemistry of other organophosphorus compounds such as chemical warfare agents, pesticides, and other hazardous pollutants.

Compressed air from tank 10, regulated by flowmeter 20, was used as a carrier gas at a flow rate of 50 ml/min. The ultra high purity air was passed at a rate of 50 ml/min through a saturator or bubbler 40 filled with 100% liquid DMMP at a room temperature of 20–22° C. in order to create a DMMP vapor/air stream containing of 1300 ppm DMMP in room temperature air. The DMMP vapor/air stream flows through a catalyst bed 30 in reactor 50, which is heated by a tubular furnace 60 equipped with a temperature controller 80. The reactor products pass through gas chromatographs 90 and 91 for on-line analysis. A mass of 100 milligrams of catalyst was used for each test. One gas chromatograph, equipped with a flame ionization detector, was used for analyzing dimethyl ether, methanol, DMMP, and other organic compounds. The other gas chromatograph, equipped with a thermal conductivity detector, was used to detect CO and $CO_2$, which are decomposition products. The catalyst compositions that were synthesized and tested, the reaction temperature and the approximate effective time are summarized in Table 2.

TABLE 2

| Test ID | Catalyst | Support | Reactor Temp. (° C.) | Approximate Effective Time (hr) |
|---|---|---|---|---|
| A | $Al_2O_3$ | $\gamma$-$Al_2O_3$ | 400 | 4 |
| B1 | Activated Carbon | — | 300 | — |
| B2 | Activated Carbon | — | 400 | >100 (Concentration of DMMP decreases after 30 hr, then increases again) |
| B3 | Graphite | — | 400 | <0.5 |
| B4 | 1% Pt + 20% Carbon/$TiO_2$ | $TiO_2$ (Degussa P-25) | 400 | >90 (Concentration of DMMP decreases after 25 hr, then increases again) |
| C | 10% $Cu/Al_2O_3$ | $\gamma$-$Al_2O_3$ | 400 | 7.5 |
| F | 10% $Fe/Al_2O_3$ | $\gamma$-$Al_2O_3$ | 400 | 4 |
| N | 10% $Ni/Al_2O_3$ | $\gamma$-$Al_2O_3$ | 400 | 1.5 |
| P1 | 1% $Pt/Al_2O_3$ (from Aldrich) | $\gamma$-$Al_2O_3$ | 400 | 1.5 |
| P2 | 1% $Pt/Al_2O_3$ | $\gamma$-$Al_2O_3$ | 400 | 15 |
| P3 | 1% $Pt/SiO_2$ | $SiO_2$ (amorphous) | 400 | 10 |
| P4 | 1% $Pt/TiO_2$ | $TiO_2$ (anatase) | 400 | 6 |
| P5 | 1% $Pt/TiO_2$ | $TiO_2$ (amorphous) | 400 | 4 (Concentration of DMMP fluctuates) |
| V1 | 1% $V/Al_2O_3$ | $\gamma$-$Al_2O_3$ | 400 | 10 |
| V2 | 10% $V/Al_2O_3$ | $\gamma$-$Al_2O_3$ | 400 | >100 (Concentration of DMMP decreases after 12 hr, then increases, and fluctuates) |
| V3 | 10% $V/SiO_2$ | $SiO_2$ (amorphous) | 400 | >100 (Concentration of DMMP decreases after 25 hr, then increases and fluctuates) |
| V4 | 10% $V/SiO_2$ | $SiO_2$ (amorphous) | 350 | 2 |
| V5 | 10% $V/SiO_2$ | $SiO_2$ (amorphous) | 450 | >100 |
| V6 | 10% $V/TiO_2$ | $TiO_2$ (Degussa P-25) | 400 | 1 |
| M | 10% $Mo/SiO_2$ | $SiO_2$ (amorphous) | 400 | 2 |
| V7 | $V_2O_5$ | — | 400 | <0.5 |

As seen in Table 2, 10%$V/SiO_2$ at both 400 C. and 450 C. (Tests V3, V5), and 10%$V/Al_2O_3$ at 400 C. (Test V2) maintained effectiveness at substantially 100% DMMP destruction for over 100 hours. Uncatalyzed activated carbon, when heated to 400° C. (Test B2), also maintained effectiveness at substantially 100% DMMP destruction for over 100 hours, but was ineffective at 300 C. (Test B1). The Pt/carbon/titania catalyst on titania support composition maintained its effectiveness for over 90 hours, despite a dip in effectiveness at 25 hours. Uncatalyzed alumina, graphite, copper, iron, nickel and molybdenum catalyst based compositions proved ineffective (Tests A, B3, C, F, N, M). Additionally, 1%Pt catalyst on alumina, silica or titania support material, even at 400 C., was relatively ineffective over time for the destruction of DMMP (Tests P2, P3, P4, P5).

The mechanism resulting in high activity may be based on the formation of phosphoric acid or phosphorus pentoxide (P2O5), which have been used as activating agents for carbon activation. Phosphoric acid is generally impregnated in carbon materials and then pyrolyzed between 350–500° C. Upon calcination, the impregnated chemicals dehydrate the carbon materials, which results in charring and aromatization of the carbon skeleton and the creation of a porous structure.

In our process, the P2O5 and coke formed during the decomposition of the organophosphonates may create a porous structure similar to active carbon at the reactor temperature we have employed (300–450° C.). P2O5 is accumulated in the catalytic bed or downstream along the reactor walls during the protection period during which the original catalyst shows 100% conversion of DMMP (to our detection limit of roughly 0.1%). After the original catalyst deactivates, accumulated P2O5 starts to function similar to a catalyst. The apparent conversion of DMMP at this time is still very high (close to 100%). However, the prerequisite for this continued conversion is that an adequate amount of P2O5 be deposited in the reactor. For many catalysts utilized in the prior art literature, for instance, Pt/Al2O3, this prerequisite is not satisfied because of the consumption of P2O5 in the reaction of Al2O3 and P2O5. In the catalyst compositions of the present invention, the vanadium oxide (V2O5) as well as the inert support SiO2 are resistant to poisoning by P2O5. Thus, enough P2O5 is accumulated in the catalyst bed and reactor wall to subsequently also operate as a catalyst. This is a self-catalytic reaction since the catalyst, P2O5, is from the reactant itself Similarly, this observation is seen with activated carbon because activated carbon does not react with P2O5. Thus the activated carbon as well as vanadium catalysts act as inducing catalysts for producing the P2O5 catalyst.

Figure 2:
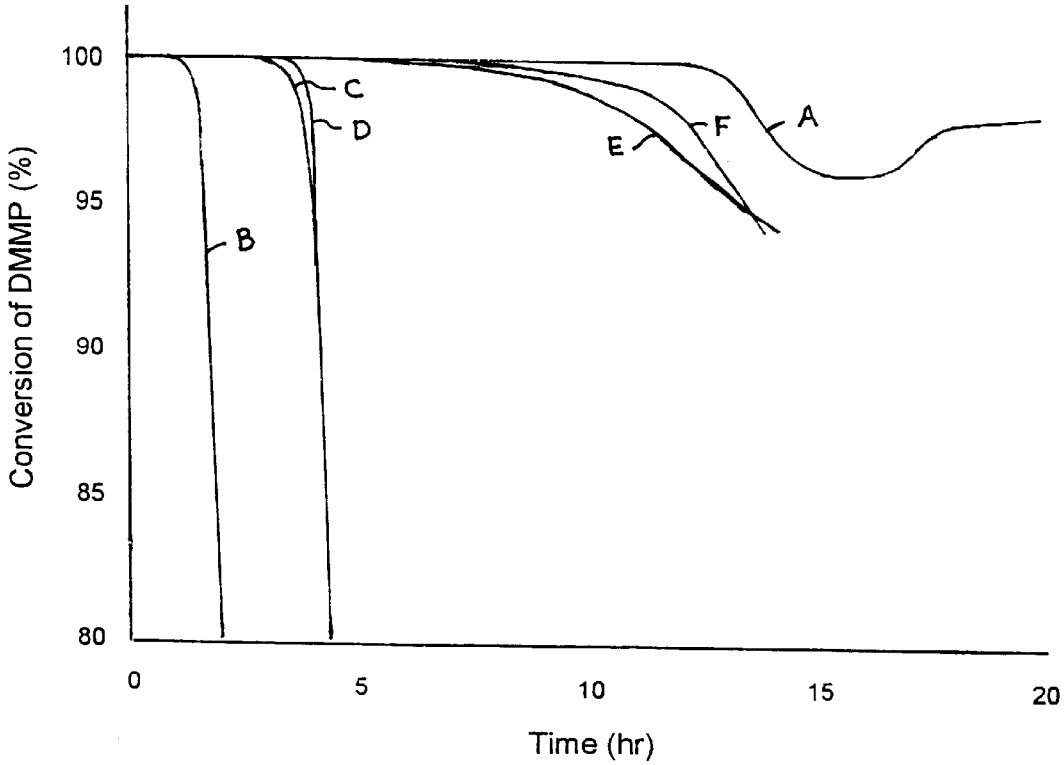
FIG. 2 is a graph showing the DMMP conversion activity of various compositions over time.

FIG. 2 shows the duration of DMMP conversion at 400° C. for different metal oxides supported on $\gamma$-$Al_2O_3$. The loading contents of Ni, Fe, Cu, and V were 10% by weight. Protection time or protection period is defined as the initial period during which substantially 100% conversion of DMMP is maintained, and is a very important parameter for evaluation of a catalyst's effectiveness. The sequence of protection times obtained on these catalysts compositions were: 10%V/$Al_2O_3$ (12.5 hours)>1%Pt/$Al_2O_3$ (8.5 hours) >10%Cu/$Al_2O_3$ (7.5 hours)>$Al_2O_3$ (4.0 hours)>10%Fe/$Al_2O_3$ (3.5 hours)>10%Ni/$Al_2O_3$ (1.5 hours). The vanadium catalyst composition exhibited more effective catalytic activity than any other metal oxide catalyst compositions examined. After passing through a relatively short initial protection period, nickel, iron and bare $Al_2O_3$ catalyst compositions lost activity abruptly.

As seen in FIG. 2, platinized $Al_2O_3$ (curve F), as a reference, is a more effective catalyst composition than copper, nickel and iron catalysts, but not as good as vanadium catalysts (curve A). In terms of protection time, Pt/$Al_2O_3$ (curve F) was superior to Cu-based systems (curve E). The protection time of 4 hours obtained on bare $\gamma$-$Al_2O_3$ (curve D) could be due to the stoichiometric reaction between $Al_2O_3$ and DMMP. The protection times for nickel catalysts (curve B) and iron catalysts (curve C) were shorter than those for bare $Al_2O_3$. The explanation for this observation is that the bulk $Al_2O_3$ was covered by the phosphorus-poisoned iron, or nickel compounds (such as $FePO_4$, or $Ni_3(PO_4)_2$), which hindered the further exposure of $Al_2O_3$ to DMMP.

Figure 3:
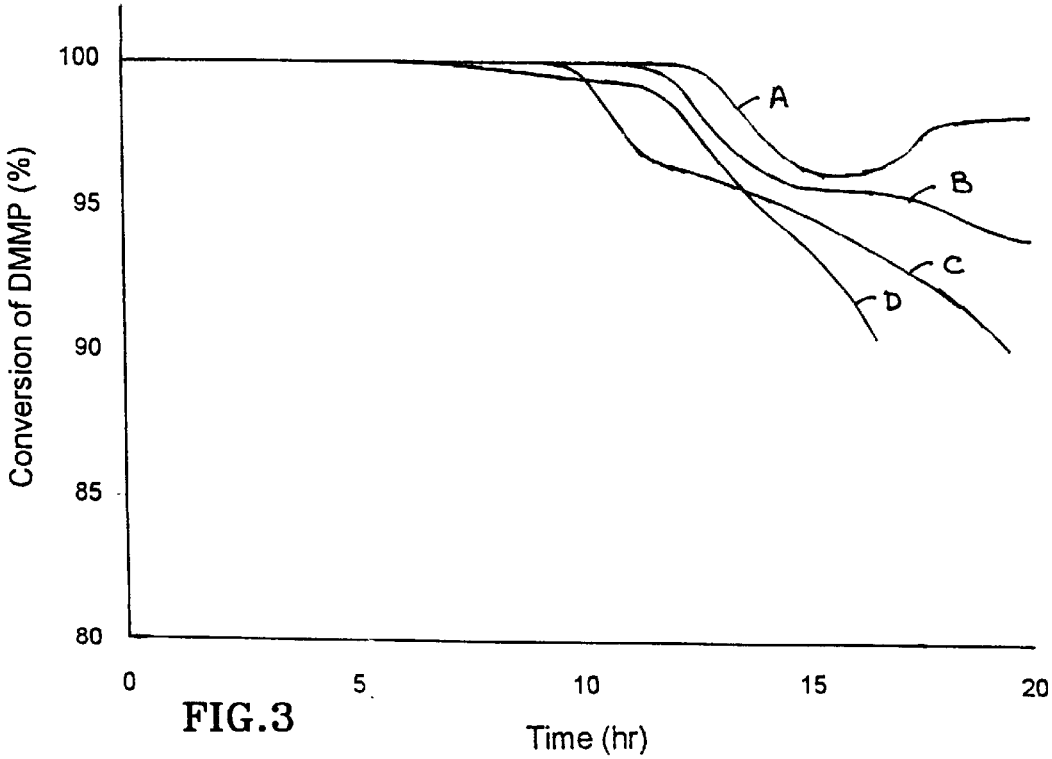
FIG. 3 is a graph showing the DMMP conversion activity of various vanadium based catalyst compositions over time.

Since the vanadium catalyst composition is the more effective composition for oxidation of DMMP, the effects of vanadium content on catalytic activity were investigated in order to optimize the catalyst composition for high activity and low metal loading for practical use. FIG. 3 shows the initial protection periods of vanadium catalyst compositions with different loading contents ranging from 1% to 10% by weight. The initial protection periods on these catalysts were: 10%V (curve A)—12.5 hours; 5%V (curve B)—11.5 hours; 1%V (curve C)—9.5 hours; and 15%V (curve D)—8 hours. Compared to 5%V/$Al_2O_3$ catalyst, the initial protection period for 10%V/$Al_2O_3$ increased by only one hour although the contents of vanadium were doubled. Furthermore, a short protection time was obtained on 15%V/$Al_2O_3$. This observation reveals that high catalyst loading does not benefit the activity of catalyst compositions. An interpretation is that high loading decreases the surface area, in particular for the sample with loading contents up to 15%. Pure $V_2O_5$ with a surface area of 1.6 $m^2/g$ did not show high activity since the protection time was less than half an hour.

With respect to the 10%V/$Al_2O_3$ catalyst composition, it is of interest to point out that the conversion of DMMP went up after 17 h. In our experiments, formation of a large amount of coke was observed starting from the catalyst bed and along the reactor walls. The coke may have been generated via dehydration of methanol on $P_2O_5$, products from the decomposition of DMMP. The deposited coke itself was able to catalyze decomposition of DMMP. After passing through the protection period, the coke likely started to function similar to a catalyst. Thus, the conversion increased once again and was maintained at a high level (about 98%).

Unlike the 10%V/$Al_2O_3$ catalyst composition, no rebound in conversion of DMMP occurred on 15%, 5% and 1% vanadium catalyst compositions. It is noteworthy to mention that the protection time on 1%V/$Al_2O_3$ catalyst (9.5 h) is found to be one hour longer than that on 1%Pt/$Al_2O_3$ catalyst (8.5 h) at this temperature. In other words, vanadium catalysts are of practical interest to replace platinum catalysts for catalytic oxidation of DMMP.

Figure 4:
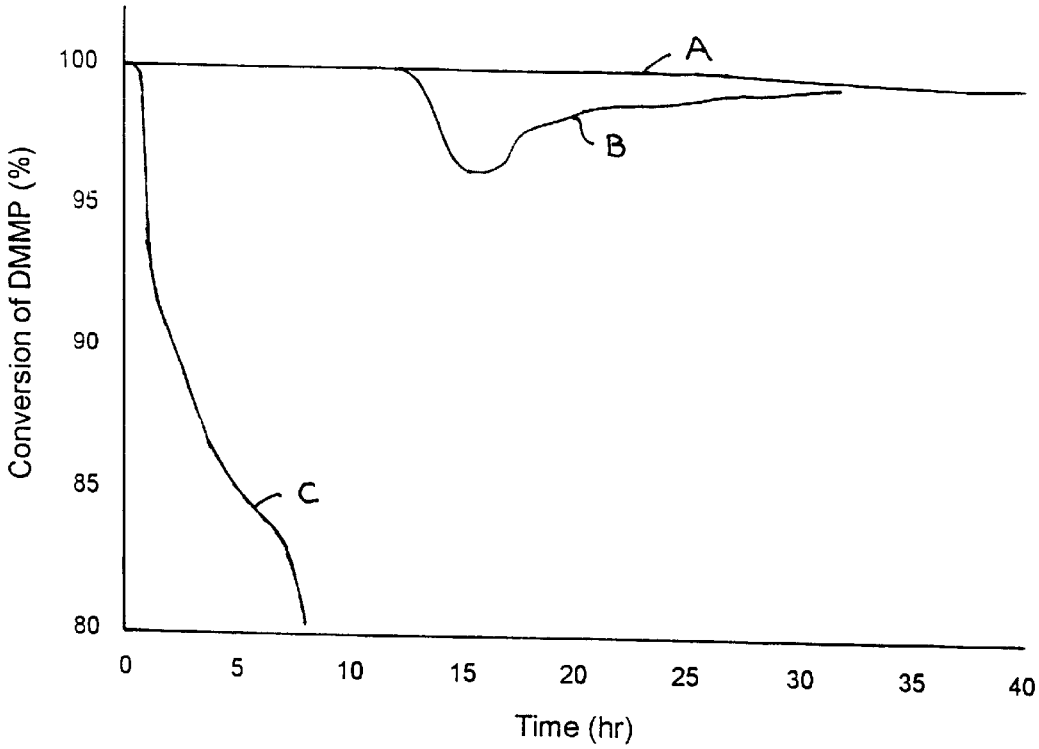
FIG. 4 is a graph showing the DMMP conversion activity of various vanadium based catalyst compositions over time.

FIG. 4 shows the conversion of DMMP on vanadium (10 wt %) based catalyst compositions with the vanadium catalyst supported on $SiO_2$ (curve A), $Al_2O_3$ (curve B), and $TiO_2$ (curve C), respectively. The disadvantage for the utilization of $\gamma$-$Al_2O_3$ as a support is that $\gamma$-$Al_2O_3$ has a degree of basicity and is able to react with acidic $P_2O_5$ to form $AlPO_4$, which can give rise to a drastic loss of surface area. For comparison, the relatively acidic supports, such as $SiO_2$ and $TiO_2$, were evaluated. The $SiO_2$ was amorphous and the commercially available P-25 $TiO_2$ was a mixture of anatase and rutile with a ratio of 75:25. The catalytic activity was markedly enhanced using $SiO_2$ for the support material on which a protection time of 25 hours was obtained. The $SiO_2$ catalyst composition was actually run for 100 hours with no significant deactivation. After passing through the protection time, the 10%V/$SiO_2$ catalyst deactivated slightly and the conversion of DMMP fluctuated within 99–100%. However, 10%V/$TiO_2$ catalyst deactivated very quickly. The low surface area of this catalyst (29.9 $m^2/g$) may be the explanation of poor activity. Therefore, 10% vanadium supported on $SiO_2$ was the best catalyst for the decomposition of DMMP.

Figure 5:
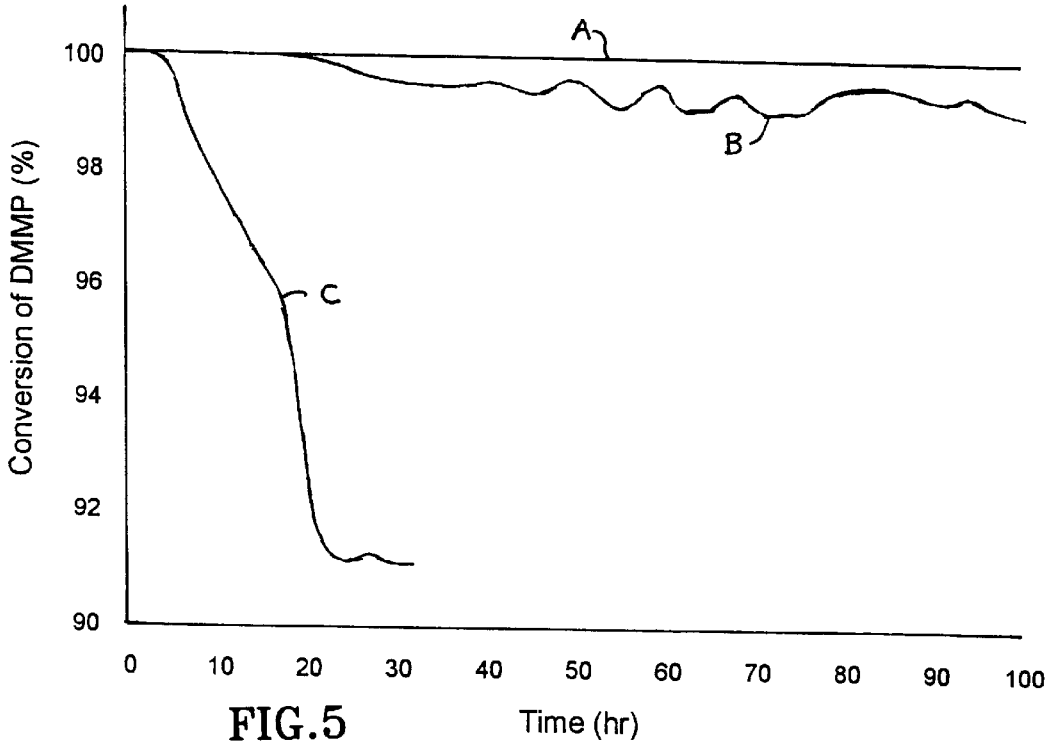
FIG. 5 is a graph showing the DMMP conversion activity of a vanadium based catalyst composition reacting at temperatures of 350 C., 400 C. and 450 C. over time.

The oxidation of DMMP with the vanadium based catalyst compositions is a temperature sensitive reaction primarily because $P_2O_5$, a decomposing product, has a high sublimation point (350° C.). At low temperatures, $P_2O_5$ decomposes on the catalyst surfaces. In order to investigate the effects of temperature on catalytic activity, temperature dependence experiments were conducted on 10%V/$SiO_2$ catalyst. As seen in FIG. 5, the protection times at 350° C. (curve C), 400° C. (curve B) and 450° C. (curve A) were 5 hours, 25 hours and over 100 hours, respectively. At the temperature as low as 350° C., which is the sublimation point of $P_2O_5$, coverage originating from the accumulation of phosphorus species on catalyst surfaces led to a drastic loss of active sites, which is likely the main reason explaining the deactivation of the catalyst at such low temperatures.

In contrast, 100% effective catalyst activity was maintained more than 100 hours at 450° C. and would likely continue well beyond 100 hours.

The vanadium based catalysts and platinum catalyst appear to be the most active, with vanadium, at a level of 10%, by weight, being the only catalyst exhibiting the ability to maintain 100% DMMP conversion, with no indication of deactivation, over extended periods of time. Vanadium based catalyst compositions having vanadium present in amounts greater than about 5% are preferred, with alumina and silica being the preferred support materials.

Manganese oxide, in either an amorphous or crystalline form, based compositions also proved effective for the decomposition of DMMP and other hazardous. Compositions comprising amorphous manganese oxide (AMO) supported on a substrate also show high activity for photo-assisted catalytic oxidation applications. AMO (amorphous manganese oxide) catalyst compositions were prepared by the reduction of $KMnO_4$ in distilled deionized water with oxalic acid. The precipitated materials were washed with water and dried in vacuum at room temperature. The resultant brown materials are amorphous and different from crystalline $Mn(C_2O_4)_3$, $Mn(C_2O_4)OH$ and similar to isolated transition metal oxalate complexes in color, structural properties, and composition. In this preparation, non-stoichiometric amounts of oxalic acid were added in order to obtain intermediate ($Mn^{4+} \rightarrow Mn^{2+}$) mixed valent manganese oxide compositions. Infrared experiments showed only traces of oxalic acid in the resultant materials. After photolysis, the trace of oxalate or oxalic acid was present. Potassium was present to accommodate the reduced manganese (IV) ions.

Figure 6:
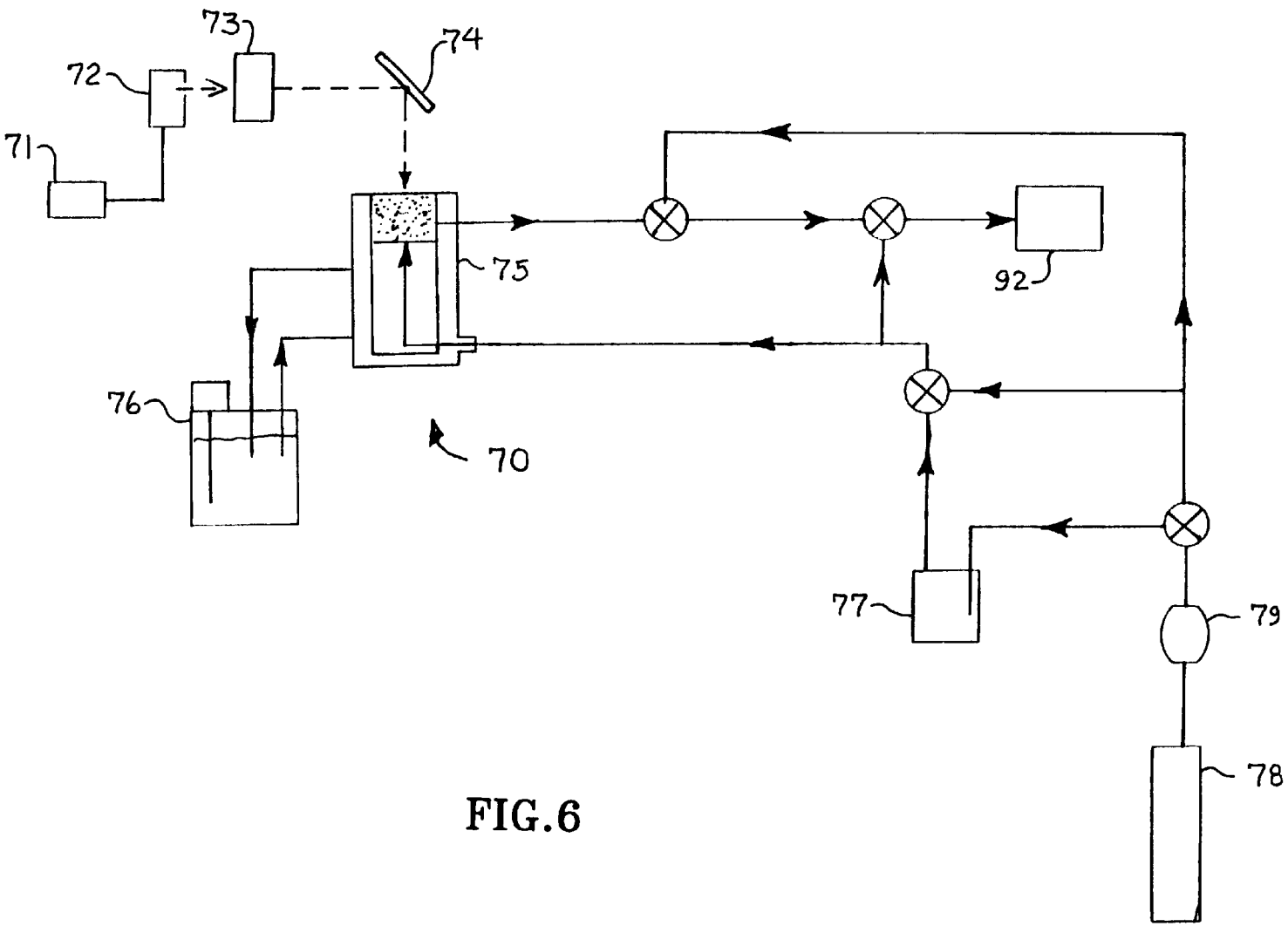
FIG. 6 is a schematic diagram illustrating a photocatalytic reactor system for the destruction of organophosphorus compounds.

The heterogeneous photocatalytic reactor system 70 depicted schematically in FIG. 6 was used to evaluate the effectiveness of the manganese oxide based catalyst compositions. Power supply (Kratos, Schoeffel Instruments, model LPS 255HR) 71 was used to power the 1000 W Xe arc lamp 72 which was used as a source of light. As no filters were used, the radiation from the lamp spanned over the entire ultraviolet and visible range (~200–800 nm). Water bottle 73 was placed in between the light source and the reactor 75 to remove heat and infrared radiation. Light was directed by mirror 74 into the reactor 75, a stainless-steel vessel containing a thin layer (50 mg) of catalyst composition, that was disposed on a Gelman Sciences glass fiber filter at the top of the vessel and exposed to the light. The reactor 74 was kept at a temperature of about 40° C. for photocatalytic studies using the water bath and temperature controller 76. The outlet lines were heated to 110° C. to prevent condensation of DMMP and other products. Temperature measurements made inside the reactor 75 during irradiation indicate that slight temperature increases (~65° C.) occur. Air from tank 78 was used as the oxidant and was passed through flow controller 79 and into bubbler 77 containing liquid DMMP, which was kept in a water bath at 25° C. The flow rate of air was maintain at 30 mL/min. Under these conditions, the inlet DMMP concentration is 0.13 mol % or 1300 ppm. Reactants and products were analyzed using gas chromatograph 92 equipped with an automatic gas-sampling valve. A Carbowax 20M capillary column with flame ionization detection was used to analyze for DMMP and methanol. $CO_2$ was analyzed using a GSC Gas Pro capillary column with thermal conductivity detection.

The reaction of DMMP with AMO under dark and irradiated conditions was studied. In the absence of AMO, no decomposition of DMMP occurs. In the first approximately 130 minutes of the test run, the reaction was performed under dark conditions to allow the outlet DMMP concentration to equal the inlet DMMP concentration. The long times required for equilibration indicate that AMO can also be used as an effective adsorbent for DMMP. After the initial roughly 130 minutes, the lamp was turned on and the reaction was allowed to continue for another couple of hours. Under dark conditions, the concentration of DMMP initially decreases to approximately 17% of the original concentration, then climbs slowly back to the inlet concentration after 2 h. When the lamp is turned on, the DMMP concentration increases to over three times the original concentration, then quickly falls back to the original inlet concentration where it levels off. The chromatographic results using flame ionization detection also showed the presence of another peak, which was identified as methanol. Under dark conditions, small amounts of MeOH were produced, starting after 40 min of reaction. The average MeOH concentration during this portion of the reaction was 20 ppm. When the lamp was switched on, the MeOH concentration increased dramatically to 340 ppm. The MeOH concentration then quickly decreased to 50 ppm where it slowly leveled off.

Another product that formed during the DMMP reactions was $CO_2$. For the most part, no $CO_2$ was formed under dark conditions. Some $CO_2$ peaks were observed towards the beginning of the reaction; presumably from noise or trace amounts of $CO_2$ remaining in the AMO. After the light was turned on there was a large increase in the $CO_2$ concentration, corresponding to 2100 ppm. The concentration of $CO_2$ then quickly dropped to 170 ppm, where it remained fairly steady.

The reaction of DMMP with AMO at elevated temperatures, i.e., operating as a thermal catalyst as opposed to a photocatalyst, was also studied. The protection times are significantly longer for thermally activated catalysis compared to photocatalysis. In the optimum case, 100% destruction of DMMP (to our limit of detection) was maintained for slightly over 50 minutes at a temperature of 300° C.

The manganese oxide based catalyst compositions of the present invention may also be doped with iron and/or using an iron oxide support. Other dopants, such as Ce, Mo, Pt, and V for example, may also be included. Magnesium oxide and silicon dioxide may also be used as supports for the manganese oxide catalyst.

Further, the present invention contemplates catalytic activity regeneration via washing of the spent catalyst composition. Although catalysts poison relatively rapidly (with the exception of some of the vanadium-based catalysts discussed previously), degraded catalyst compositions may be rejuvenated by washing the water-soluble phosphate-type species that are formed as products upon the catalyst composition thereby poisoning the catalyst material.

For example, after several reactions with DMMP, AMO was collected (~90 mg) and placed in 100 mL of DDW and stirred for approximately 1 h. The sample was filtered and washed with DDW several times. The AMO sample was dried overnight in air at 110° C., and the following day was re-tested as a catalyst in reactions of DMMP. Only DMMP and MeOH were analyzed in these experiments. The results were similar to those obtained when using fresh AMO. At the beginning of the reaction under dark conditions, the DMMP concentration decreases, although not as dramatically as in fresh AMO samples. The DMMP concentration then slowly increases to the inlet level. When the lamp was turned on, the DMMP concentration increases significantly as with fresh AMO, then levels off after several hours to concentrations near the inlet concentration. The formation of MeOH also follows similar trends as fresh AMO. Under dark conditions, small amounts of MeOH (50 ppm) are formed, starting after 30 min. The MeOH concentration decreases slightly until the light is switched on. After the light is turned on, a large amount of MeOH (400 ppm) is initially observed. This corresponds to approximately the same amount of MeOH seen with fresh AMO samples. The production of MeOH then decreases as was observed for fresh AMO.

It is believed that washing of the catalyst may be used to regenerate any of the catalyst compositions mentioned previously. As an additional specific example, the catalytic activity with DMMP of titania photocatalyst, TiO2, was evaluated to verify washing would regenerate spent titania catalyst material. It was found that a deactivated titania catalyst may be easily regenerated not only by washing with water, but also by subjecting the catalyst in situ to UV light in the absence of DMMP. This rejuvenation by exposure to UV light likely resulted from oxidation of adsorbed DMMP and photodesorption of the adsorbed intermediates during the reconditioning period. The presence of adsorbed intermediates has been suspected to be a root cause of titania catalyst deactivation. The water wash strategy was found to completely rejuvenate the catalyst, while a 2-hour exposure to UV irradiation was found to partially, but not completely, rejuvenate the catalyst.

In summary, the AMO based catalyst compositions of the present invention may be used to decompose organophosphonates either at room temperature via photocatalytic reaction or via thermal reaction at elevated temperatures above 300° C. and preferably above 350° C. Further, in contrast to titania, the most common photocatalyst in use, which requires UV light for initiation, the AMO based catalyst compositions of the present invention require only visible light at approximately 425 nm. Additionally, after prolonged use/degradation, the metal-oxide catalyst compositions may be regenerated by heating, washing with water or other solvents, treating with light, purging with oxygen (or other purge gas) and/or treating with microwave radiation to desorb surface species.

The manganese oxide catalyst compositions and vanadium based catalyst compositions of the present invention, as well as platinum based catalyst and activated carbon compositions, appear to be exceptional for destroying hazardous compounds, such as organophosphorus compounds, including chemical warfare agents, pesticides and solvents, as well as refrigerants and other chlorinated species. The catalysts of the present invention may also be used to decompose VOCs (volatile organic compounds) and be incorporated into an air quality control system for indoor, outdoor and vehicular environments. More specifically, the AMO photoactive catalyst compositions of the present invention may be applied as a thin coating on a support such that it may be effectively irradiated by visible light. The catalyst compositions in combination with light generating or light directing devices (e.g., mirrors, reflectors, lenses, fibers) may be incorporated into an air cleaner system. When contaminated air is passed through the device, the coated surfaces will permit photocatalytic decomposition of pollutants. The primary advantage of using AMO is that visible light is sufficient to activate the photocatalytic mechanism as opposed to the UV light required for TiO2 activation. Such an air cleaning system may be used in a building, outdoors, in space life support systems, or in aircraft air-cleaning systems.

The AMO and vanadium based catalyst compositions of the present invention may also be used in a refrigerant disposal system, that may or may not be a part of a refrigerant recovery system for the on-site destruction of recovered refrigerants. These catalyst compositions may also be used to thermo-catalytically destroy other chlorinated species such as solvent, degreasing agents, and other hazardous compounds.

The AMO and vanadium/vanadium oxide based catalyst compositions, as well as activated carbon and P2O5, are useful for the destruction of organophosphorus compounds, specifically chemical warfare agents and pesticides. These catalysts may be used in such applications in personnel protection devices, for example gas masks, and in vehicular and aerospace air filtration systems, and in building air filtration/ventilation systems. A reactor comprised of either a packed bed of catalyst or catalyst coating on a porous substrate (for low pressure drop operation) may be used. For photoactive catalysts, light may be directed into the reactor. For thermally active catalysts, the catalysts may be heated resistively, directly in situ; or by microwave radiation, or by external means such as by a furnace. Once the catalyst is activated and as gas passes through the reactor, the organophosphorus parent species will be decomposed to relatively benign byproducts.

Additionally, the catalyst compositions of the present invention may also be incorporated into sensors as part of the detection system for organophosphorus compounds.

What is claimed is:

1. A method of decomposing organophosphonate compounds comprising contacting the organophosphonate compounds with a catalyst composition heated to a temperature of at least 300 C, said catalyst composition containing a catalyst selected from the group consisting of manganese oxide, vanadium, vanadium oxide, and mixtures thereof, and a catalyst selected from the group consisting of activated carbon, diphosphorus pentaoxide and mixtures thereof.

2. A method as recited in claim 1 wherein the catalyst composition is heated to a temperature of at least 350 C.

3. A method as recited in claim 2 wherein the catalyst composition is heated to a temperature of at least 400 C.

* * * * *